US011462144B2

(12) United States Patent
Furukawa et al.

(10) Patent No.: US 11,462,144 B2
(45) Date of Patent: Oct. 4, 2022

(54) DISPLAY DEVICE AND DRIVING METHOD THEREFOR

(71) Applicant: SHARP KABUSHIKI KAISHA, Sakai (JP)

(72) Inventors: Hiroyuki Furukawa, Sakai (JP); Masafumi Ueno, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/275,926

(22) PCT Filed: Sep. 28, 2018

(86) PCT No.: PCT/JP2018/036388
§ 371 (c)(1),
(2) Date: Mar. 12, 2021

(87) PCT Pub. No.: WO2020/065947
PCT Pub. Date: Apr. 2, 2020

(65) Prior Publication Data
US 2021/0264839 A1 Aug. 26, 2021

(51) Int. Cl.
*G09G 3/20* (2006.01)
*G09G 3/3283* (2016.01)
(Continued)

(52) U.S. Cl.
CPC ..... *G09G 3/2003* (2013.01); *G09G 3/3233* (2013.01); *G09G 3/3283* (2013.01);
(Continued)

(58) Field of Classification Search
CPC .. G09G 3/3283; G09G 3/2003; G09G 3/3233; G09G 3/3291; G09G 2300/0861;
(Continued)

(56) References Cited

U.S. PATENT DOCUMENTS

2002/0101395 A1 8/2002 Inukai
2010/0225634 A1 9/2010 Levey et al.
(Continued)

FOREIGN PATENT DOCUMENTS

JP 2002-304156 A 10/2002
JP 2012-519881 A 8/2012
WO 2014/112299 A1 7/2014

*Primary Examiner* — Jimmy H Nguyen
(74) *Attorney, Agent, or Firm* — ScienBiziP, P.C.

(57) ABSTRACT

A display device is implemented that can more efficiently compensate for degradation of drive transistors by promptly determining an average degradation level of the drive transistors on the entire screen. The display device is provided with a total current measuring circuit (50) that measures, as a total current, drive currents flowing through all of a plurality of pixel circuits or two or more pixel circuits in a state where a specific image is displayed; a determination data storage unit (110) that holds determination data used to determine whether to perform characteristics detection monitoring for detecting characteristics of the drive transistors; and a determining unit (120) that determines whether to perform the characteristics detection monitoring, based on the total current and the determination data.

20 Claims, 14 Drawing Sheets

(51) Int. Cl.
*G09G 3/3233* (2016.01)
*G09G 3/3291* (2016.01)

(52) U.S. Cl.
CPC ..... *G09G 3/3291* (2013.01); *G09G 2320/029* (2013.01); *G09G 2320/0242* (2013.01); *G09G 2330/12* (2013.01)

(58) Field of Classification Search
CPC ... G09G 2310/0262; G09G 2320/0295; G09G 2320/029; G09G 2320/045; G09G 2320/0242; G09G 2330/12
USPC ..... 345/690, 76
See application file for complete search history.

(56) References Cited

U.S. PATENT DOCUMENTS

| | | | | |
|---|---|---|---|---|
| 2015/0356899 | A1 | 12/2015 | Yamanaka et al. | |
| 2017/0053587 | A1* | 2/2017 | Kim | G09G 3/2092 |
| 2018/0114815 | A1* | 4/2018 | Lee | H01L 51/0031 |

* cited by examiner

DISPLAY DEVICE AND DRIVING METHOD THEREFOR

TECHNICAL FIELD

The following disclosure relates to a display device and a driving method for the display device, and more specifically to a display device including pixel circuits including display elements driven by a current, such as organic EL elements, and a driving method for the display device.

BACKGROUND ART

In recent years, an organic EL display device including pixel circuits including organic EL elements has been put to practical use. The organic EL elements are also called organic light-emitting diodes (OLEDs), and are self-emissive display elements that emit light at luminance depending on a current flowing therethrough. As such, since the organic EL elements are self-emissive display elements, the organic EL display device can easily achieve slimming down, a reduction in power consumption, an increase in luminance, etc., over a liquid crystal display device that requires a backlight a color filter, and the like.

As drive systems for the organic EL display device, there are known a passive matrix system (also called a simple matrix system) and an active matrix system. An organic EL display device that adopts the passive matrix system has a simple structure, but has difficulty in increasing size and resolution. On the other hand, an organic EL display device that adopts the active matrix system (hereinafter, referred to as "active matrix-type organic EL display device") can easily achieve an increase in size and resolution over the organic EL display device that adopts the passive matrix system.

In the active matrix-type organic EL display device, a plurality of pixel circuits are formed in matrix form. The pixel circuits of the active matrix-type organic EL display device each typically include an input transistor that selects a pixel; and a drive transistor that controls supply of a current to an organic EL element. Note that in the following, a current flowing through the organic EL element from the drive transistor may be referred to as "drive current".

Meanwhile, the organic EL display device typically adopts a thin-film transistor (TFT) as the drive transistor. However, a threshold voltage of the thin-film transistor changes due to degradation. Multiple drive transistors are provided in a display unit, and the degree of degradation varies between drive transistors, and thus, variations occur in threshold voltage. As a result, variations in luminance occur, degrading display quality. Hence, a process for compensating for degradation of the drive transistors is conventionally performed.

As one scheme for the compensation process, an external compensation scheme is known. According to the external compensation scheme, the magnitude of a current flowing through a drive transistor under a predetermined condition is measured by a circuit provided outside a pixel circuit. Then, based on a result of the measurement, a video signal is corrected. By this, degradation of the drive transistor is compensated for. Note that in the following, a series of processes for measuring a value of a current flowing through a circuit element such as a drive transistor under a predetermined condition to detect characteristics of the circuit element are referred to as "characteristics detection monitoring". An invention related to an organic EL display device that adopts an external compensation scheme such as that described above is disclosed in, for example, WO 2014/112299 A.

RELATED ART DOCUMENT

Patent Document

[Patent Document 1] WO 2014/112299 A

SUMMARY

Problems to be Solved

According to the above-described external compensation scheme, a degradation level of a drive transistor is determined based on a current value obtained when a predetermined voltage (monitoring voltage) is applied to a gate terminal of the drive transistor. However, unless the value of the monitoring voltage is an appropriate value, the degradation level cannot be accurately determined (an error between an estimated degradation level and an actual degradation level increases). In this regard, if information on an average degradation level on the entire screen (the entire display unit) has been obtained in advance upon performing characteristics detection monitoring, then the monitoring voltage can be adjusted based on the information. However, to implement this, prior to the characteristics detection monitoring which is original monitoring, there a need to perform monitoring for determining an average degradation level of the drive transistors on the entire screen (here, a series of processes related to measurement of current values are called "monitoring"). That is, monitoring for one screen is repeated twice. It requires, in general, several tens of seconds to several minutes to perform monitoring for one screen (because measurement of current values is performed row by row) and normal image display cannot be performed during the monitoring, and thus, it is not desirable to repeat monitoring twice. In addition, if the characteristics detection monitoring is frequently performed despite the fact that degradation of the drive transistors progresses slightly, then a process for compensating for degradation is inefficient.

Hence, an object of the following disclosure is to implement a display device that can more of efficiently compensate for degradation of drive transistors by promptly determining an average degradation level of the drive transistors on the entire screen.

Means for Solving the Problem

A display device according to some embodiments of the present disclosure is a display device including a plurality of data lines; a plurality of scanning lines; a plurality of pixel circuits provided at respective intersections of the plurality of data lines and the plurality of scanning lines, each pixel circuit including a display element driven by a current and a drive transistor configured to control a drive current of the display element; a data line drive circuit configured to apply data voltages to the plurality of data lines; a scanning line drive circuit configured to drive the plurality of scanning lines; a first power supply voltage member configured to supply a first power supply voltage to the plurality of pixel circuits; and a second power supply voltage member configured to supply a second power supply voltage to the plurality of pixel the display device having a function of performing a characteristics detection process that detects characteristics of the drive transistor, wherein in each pixel circuit, the drive transistor and the display element are provided in series between the first power supply voltage member and the second power supply voltage member, the display device includes:

a total current measuring circuit configured to measure, as a total current, drive currents flowing through al of the plurality of pixel circuits or two or more pixel circuits among the plurality of pixel circuits in a state where a data voltage is written into the plurality of pixel circuits, the data voltage corresponding to a specific image;

a determination data storage unit configured to hold determination data used to determine whether to perform the characteristics detection process; and a determining unit configured to determine whether to perform the characteristics detection process, based on the total current and the determination data, when the determining unit determines, during a determination period, to perform the characteristics detection process, it shifts from the determination period to a characteristics detection period during which the characteristics detection process is performed, and when the determining unit determines, during the determination period, not to perform the characteristics detection process, it shifts from the determination period to a display period during which normal image display is performed.

Effects of the Disclosure

According to several embodiments of the present disclosure, the display device is provided with the total current measuring circuit that measures a total current (total drive current) flowing through the entire screen or two or more pixel circuits when a specific image is displayed. Hence, an average degradation level of drive transistors can be promptly determined. Then, the determining unit determines whether to perform a characteristics detection process (a process of detecting characteristics of the drive transistors), based on the average degradation level of the drive transistors. By this, it becomes possible to perform, only when degradation has progressed, a characteristics detection process. As a result, a characteristics detection process is suppressed from being performed more often than necessary, and degradation of the drive transistors is efficiently compensated for. As described above, a display device is implemented that can more efficiently compensate for degradation of drive transistors by promptly determining an average degradation level of the drive transistors.

DESCRIPTION OF EMBODIMENTS

Embodiments will be described below with reference to the accompanying drawings. Note that in this specification, a voltage supplied to the pixel circuit upon the characteristics detection monitoring or average degradation level detection monitoring which will be described later out of data voltages supplied to a pixel circuit through a data line may be referred to as "monitoring voltage". Note also that in the following, it is assumed that m and n are integers greater than or equal to 2, i is an integer between 1 and n, inclusive, and j is an integer between 1 and m, inclusive.

1. First Embodiment

<1.1 Overall Configuration and Summary

Figure 1:
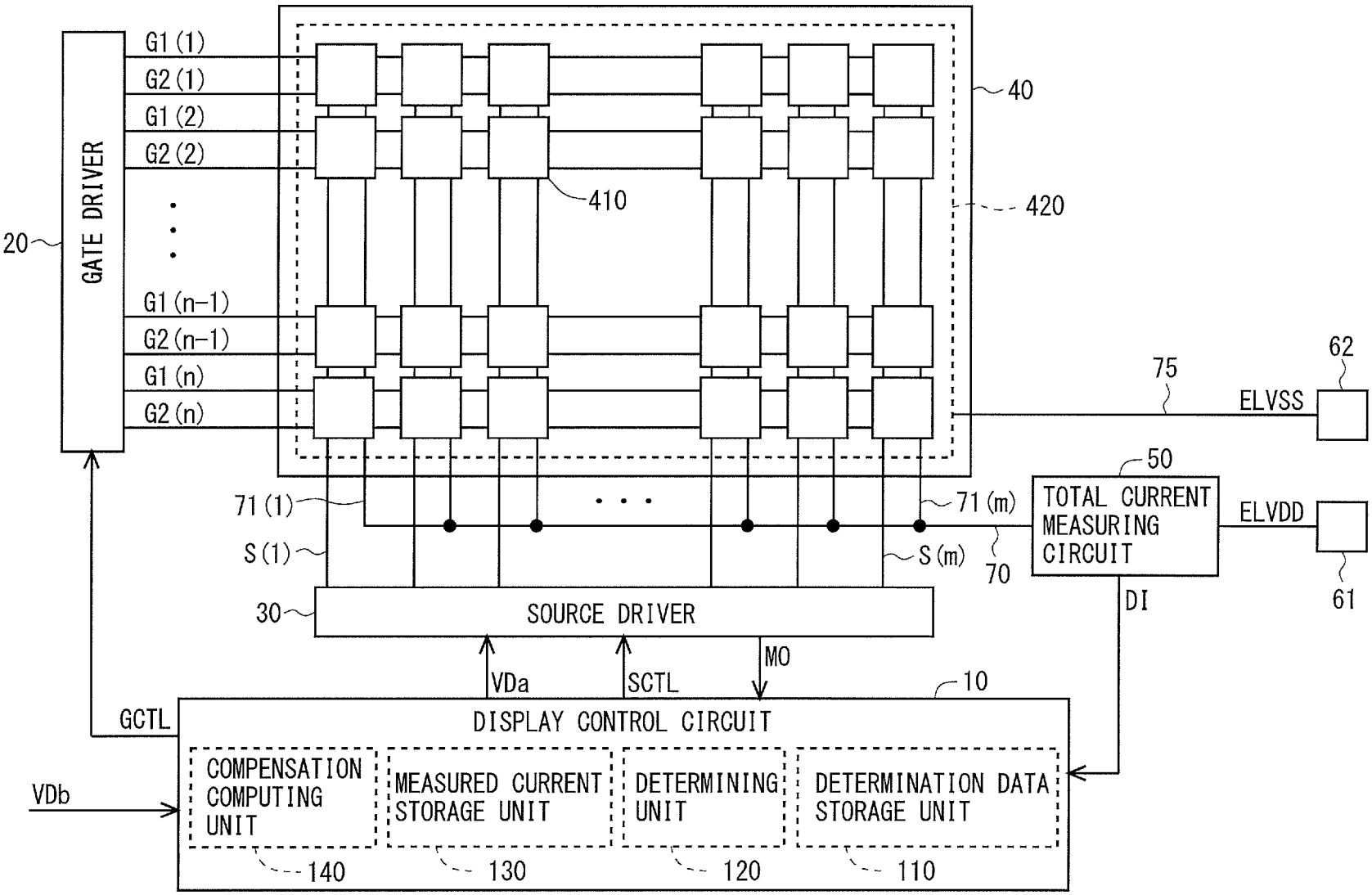
FIG. 1 is a block diagram showing an overall configuration of an active matrix-type organic EL display device according to a first embodiment.

FIG. 1 is a block diagram showing an overall configuration of an active matrix-type organic EL display device according to a first embodiment. The organic EL display device includes a display control circuit 10, a gate driver (scanning line drive circuit) 20, a source driver (data line drive circuit) 30, a display unit 40, at total current measuring circuit 50, a high voltage drive power supply 61, and a low voltage drive power supply 62. The display control circuit 10 includes a determination data storage unit 110, a determining unit 120, a measured current storage unit 130, and a compensation computing unit 140.

In organic EL display devices according to the present embodiment and second to fifth embodiments which will be described later, in order to determine an average degradation level of drive transistors on the entire screen (the entire display unit 40), currents are measured with a specific image displayed on the display unit 40 (in other words, with a data voltage corresponding to the specific image supplied to all drive transistors in a shared manner). At this time, drive currents flowing through the entire screen or two or more pixel circuits by displaying the specific image on the display unit 40 are allowed to collectively flow through a single trunk wiring line, and the currents flowing through the trunk wiring line are measured as a total current. The total current measuring circuit 50 measures the total current, and a determination as to whether to perform the above-described characteristics detection monitoring is made based on total current data DI which is a result of the measurement. Note that in the following, the specific image displayed on the display unit 40 upon measuring the total current in order to determine an average degradation level of the drive transistors on the entire screen is referred to as "total current measurement image". Note also that a series of processes in which the total current is measured with the total current measurement image displayed are referred to as "average degradation level detection monitoring".

Figure 2:
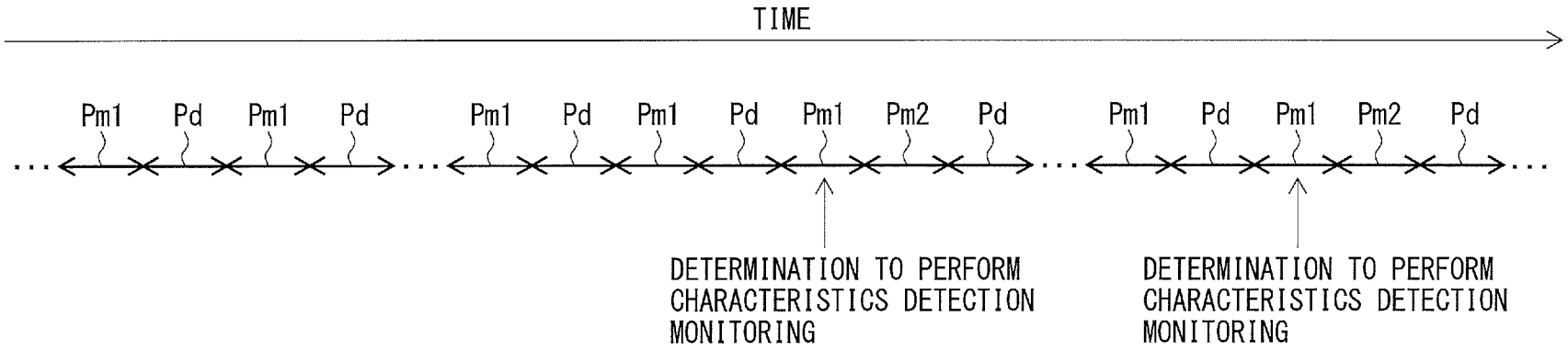
FIG. 2 is a diagram for describing periods during operation of the organic EL display device in the first embodiment.

In the present embodiment, during operation of the organic EL, display device, there are appeared a period during which it is determined whether to perform characteristics detection monitoring (characteristics detection process) (hereinafter, referred to as "determination period"), a period during which the characteristics detection monitoring is performed (hereinafter, referred to as "characteristics detection period"), and a period during which normal image display is performed (hereinafter, referred to as "display period"). Specifically, the determination period Pm1 appears at appropriate timing as shown in FIG. 2, it shifts from the determination period Pm1 to the characteristics detection period Pm2 when it is determined, during the determination period Pm1, to perform the characteristics detection monitoring, and it shifts from the determination period Pm1 to the display period Pd when it is determined, during the determination period Pm1, not to perform the characteristics detection monitoring. That is, only when it is determined, during the determination period Pm1, to perform the characteristics detection monitoring, the characteristics detection period Pm2 appears before the display period Pd. Note that in FIG. 2, the length of an arrow is not proportional to the length of a period.

Regarding FIG. 1, data lines S(1) to S(m) and n scanning lines G1(1) to G1(*n*) intersecting the m data lines S(1) S(m) are disposed in the display unit 40. In addition, n monitoring control lines G2(1) to G2(*n*) are disposed in the display unit 40 so as to have a one-to-one correspondence with the n scanning lines G1(1) to G1(*n*). The scanning lines G1(1) to G1(*n*) and the monitoring control lines G2(1) to G2(*n*) are parallel to each other. Furthermore, in the display unit 40, n×m pixel circuits 410 are provided at respective intersections of the n scanning lines G(1) to G(n) and the m data lines S(1) to S(m). By thus providing the n×m pixel circuits 410, a pixel matrix of n rows ×m columns is formed in the display unit 40. Moreover, in the display unit 40, there is provided a common electrode 420 which is a planar electrode provided in a region corresponding to all of the n×m pixel circuits 410, for supplying a common low power supply voltage ELVIS to the n×m pixel circuits 410, and there are disposed m high power supply voltage branch wiring lines 71(1) to 71(*m*) for supplying a high power supply voltage ELVDD to the n×m pixel circuits 410 so as to have a one-to-one correspondence with the m data lines S(1) to S(m). The common electrode 420 and the low voltage drive power supply 62 are connected to each other by a low power supply voltage trunk wiring line 75. The high power supply voltage branch wiring lines 71(1) to 71(*m*) are connected to a high power supply voltage trunk wiring line 70, and the high power supply voltage trunk wiring line 70 is connected to the high voltage drive power supply 61 through the total current measuring circuit 50.

In the present embodiment, a first power supply voltage is implemented by the high power supply voltage ELVDD, a second power supply voltage is implemented by the low power supply voltage ELVSS, a first power supply voltage member is implemented by the high power supply voltage branch wiring lines 71(1) to 71(*m*), and a second power supply voltage member is implemented by the common electrode 420. Note that, although an organic EL element 411 is formed in order of an anode terminal, a light-emitting layer, and a cathode terminal (common electrode) from a substrate side in the present embodiment, the configuration is not limited thereto. The organic EL element 411 may be formed in order of a cathode terminal, a light-emitting layer, and an anode terminal (common electrode) from the substrate side. In this case, a first power supply voltage is implemented by the low power supply voltage ELVSS, a second power supply voltage is implemented by the high power supply voltage ELVDD, a first power supply voltage member is implemented by low power supply voltage branch wiring lines, and a second power supply voltage member is implemented by the common electrode.

Note that in the following, when the m data lines S(1) to S(m) do not need to be distinguished from each other, the data lines are simply given reference character S. Likewise, when the n scanning lines G1(1) to G1(*n*) do not need to be distinguished from each other, the scanning lines are simply given reference character G1.

The data line S in the present embodiment is not only used as a signal line that transmits a luminance signal (video signal) for allowing the organic EL element in the pixel circuit 410 to emit light at desired luminance, but is also used as a signal line for supplying a monitoring voltage to the pixel circuit 410 upon the characteristics detection monitoring or the average degradation level detection monitoring and as a signal line serving as a path for a current that is measured by a current monitoring unit 320 which will be described later upon the characteristics detection monitoring.

Operation of each component shown in FIG. 1 will be described below. The high voltage drive power supply 61 supplies a high power supply voltage ELVDD to the high power supply voltage branch wiring lines 71(1) to 71(*m*) through the high power supply voltage trunk wiring line 70. The low voltage drive power supply 62 supplies a low power supply voltage ELTSS to the common electrode 420 through the low power supply voltage trunk wiring line 75. The total current measuring circuit 50 performs measurement of the above-described total current during the determination period. More specifically, during the determination period, the total current measuring circuit. 50 measures, as the total current, drive currents flowing through all of the n×m pixel circuits 410 in a state where a data voltage corresponding to a specific image is written into the n×m pixel circuits 410. A result of the measurement of the total current by the total current measuring circuit 50 is sent as total current data DI to the display control circuit 10.

During the determination period, the display control circuit 10 controls operation of the source driver 30 by supplying a digital video signal (a video signal corresponding to a data voltage corresponding to the total current measurement image) VDa and source control signals SCTL to the source driver 30 and controls operation of the gate driver 20 by supplying gate control signals GCTL to the gate driver 20 so that the total current measurement image is displayed on the display unit 40. In addition, during the determination period, the determining unit 120 in the display control circuit 10 determines whether to perform the characteristics detection monitoring, based on the total current data DI outputted from the total current measuring circuit 50. The determination data storage unit 110 holds determination data used to determine whether to perform the characteristics detection monitoring, and the determination data is referred to by the determining unit 120. Note that in the present embodiment, the determination data storage unit 110 holds a predetermined voltage value as the determination data.

During the characteristics detection period, the display control circuit 10 controls operation of the source driver 30 by supplying a digital video signal (a video signal corresponding to a monitoring voltage for characteristics detection) VDa and source control signals SCTL to the source driver 30 and controls operation of the gate driver 20 by supplying gate control signals GCTL to the gate driver 20 so that the characteristics detection monitoring is performed. In addition, during the characteristics detection period, the display control circuit 10 receives monitoring data MO outputted from the source driver 30. The monitoring data MO is stored in the measured current storage unit 130. Note that the monitoring data MO is data of current values measured by the characteristics detection monitoring.

During the display period, the compensation computing unit 140 in the display control circuit 10 receives input video signals (image data sent from an external source) VDb, and performs a compensation computation process on the input video signals VDb depending on the monitoring data (data of the current values) MO held in the measured current storage unit 130, and thereby generates digital video signals VDa to be supplied to the source driver 30. Then, during the display period, the display control circuit 10 controls operation of the source driver 30 by supplying the digital video signals (the video signals having been subjected to the compensation computation process) VDa and source control signals SCTL to the source driver 30 and controls operation of the gate driver 20 by supplying gate control signals GCTL to the gate driver 20 so that normal image display is performed.

Note that the source control signals SCTL include a source start pulse signal, a source clock signal, a latch strobe signal, etc. In addition, the gate control signals GCTL include a gate start pulse signal, a gate clock signal, an output enable signal, etc.

The gate driver 20 is connected to the n scanning lines G1(1) to G1(*n*) and the n monitoring control lines G2(1) to G2(*n*). The gate driver 20 is composed of a shift register, a logic circuit, and the like. The gate driver 20 drives the n scanning lines G1(1) to G1(*n*) and the n monitoring control lines G2(1) to G2(*n*), based on the gate control signals GCTL outputted from the display control circuit 10.

Figure 3:
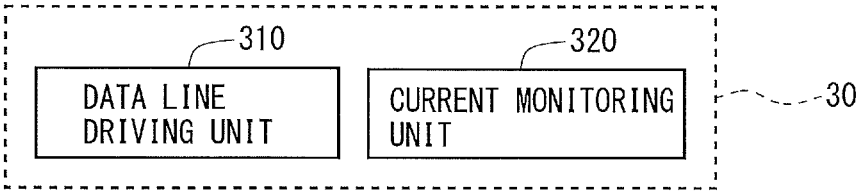
FIG. 3 is a diagram for describing functions of a source driver in the first embodiment.

The source driver 30 is connected to the m data lines S(1) to S(m). The source driver 30 selectively performs operation of driving the data lines S(1) to S(m) and operation of measuring currents flowing through the data lines S(1) to S(m). That is, as shown in FIG. 3, the source driver 30 functionally includes a portion that functions as a data line driving unit 310 that drives the data lines S(1) to S(m); and a portion that functions as a current monitoring unit 320 that measures currents outputted to the data lines S(1) to S(m) from the pixel circuits 410. The current monitoring unit 320 measures currents flowing through the data lines S(1) to S(m) and outputs the monitoring data MO generated based on measurement values.

By driving the n scanning lines G1(1) to G1(*n*), the n monitoring control tines G2(1) to G2(*n*), and the m data lines S(1) to S(m) in the above-described manner, an image based on the input video signals VDb is displayed on the display unit 40. Upon the display, a compensation computation process is performed on the input video signals VDb based on the monitoring data MO, by which degradation of drive transistors or organic EL elements is compensated for. In addition, a characteristics detection period is provided only when it is determined, during the determination period which appears at appropriate timing, to perform the characteristics detection monitoring, and thus, a process of compensating for degradation is an efficient process.

<1.2 Pixel Circuits and Source Driver>

Next, the pixel circuits 410 and the source driver 30 will be described in detail. The source driver 30 performs the following operation when functioning as the data 1 line driving unit 310. The source driver 30 receives the source control signals SCTL outputted from the display control circuit 10 and applies, as data voltages, video signal voltages generated based on target luminance to the m data lines S(1) to S(m) respectively. At this time, regarding a pulse of the source start pulse signal as a trigger, at timing at which a pulse of the source clock signal is generated, the source driver 30 sequentially holds a digital video signal VDa indicating a voltage to be applied to each data line S. Then, the held digital video signals VDa are converted into analog voltages at timing at which a pulse of the latch strobe signal is generated. The converted analog voltages are simultaneously applied as data voltages to all data lines S(1) to S(m). When the source driver 30 functions as the current monitoring unit 320, the source driver 30 applies the monitoring voltage to the data lines S(1) to S(m), and converts currents flowing through the data lines S(1) to S(m) due to this into voltages. Data obtained after the conversion is outputted as the monitoring data MO from the source driver 30.

Figure 4:
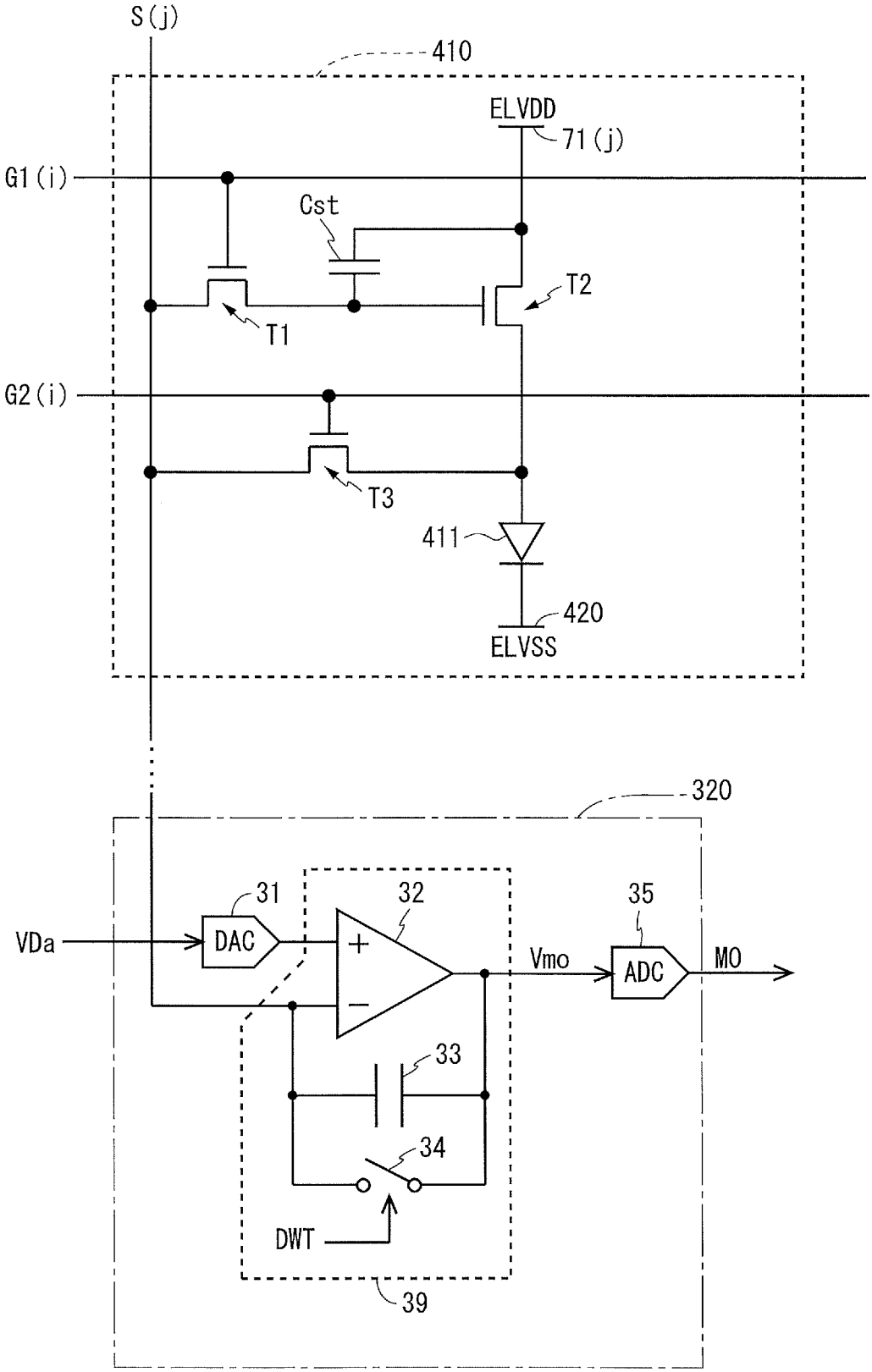
FIG. 4 is a circuit diagram showing a pixel circuit and a part of the source driver (a portion that functions as a current monitoring unit) in the first embodiment.

FIG. 4 is a circuit diagram showing a pixel circuit 410 and a part of the source driver 30 (a portion that functions as the current monitoring unit 320). Note that FIG. 4 shows a pixel circuit 410 in an ith row and a ith column and a portion of the source driver 30 corresponding to a data line S(j) in the jth column. The pixel circuit 410 includes one organic EL element 411, three transistors T1 to T3, and one capacitor Cst. The transistor T1 functions as an input transistor that selects a pixel, the transistor T2 functions as a drive transistor that controls supply of a current to the organic EL element 411, and the transistor T3 functions as a monitoring control transistor that controls whether to perform current measurement for detecting characteristics of the drive transistor T2 or the organic EL element 411.

The input transistor T1 is provided between the data line S(j) and a gate terminal of the drive transistor T2. The input transistor T is connected at its gate terminal to a scanning line G1(*i*) and connected at its source terminal to the data line S(j). The drive transistor T2 is provided in series with the organic EL element 411. The drive transistor T2 is connected at its gate terminal to a drain terminal of the input transistor T1, connected at its drain terminal to a high power supply voltage branch wiring line 71(*j*) to which a high power supply voltage ELVDD is supplied, and connected at its source terminal to an anode terminal of the organic EL element 411. The monitoring control transistor T3 is connected at its gate terminal to a monitoring control line G2(*i*), connected at its drain terminal to the anode terminal of the organic EL element 411, and connected at its source terminal to the data line S(j). The capacitor Cst is connected at its one end to the gate terminal of the drive transistor T2 and connected at its other end to the drain terminal of the drive transistor T2. A cathode terminal of the organic EL element 411 is connected to the common electrode 420 to which a low power supply voltage ELVSS is supplied. Note that for the transistors T1 to T3 in the pixel circuit 410, an oxide TFT (a thin-film transistor using an oxide semiconductor as a channel layer), an amorphous silicon TFT, etc., can be adopted. The oxide TFT is, for example, a TFT containing indium gallium zinc oxide (InGaZnO). By adopting oxide TFTs, it becomes possible to achieve, for example, an increase in resolution and a reduction in power consumption.

As shown in FIG. 4, the current monitoring unit 320 includes a DA converter (DAC) 31, an operational amplifier 32, a capacitor 33, a switch 34, and an AD converter (ADC) 35. The operational amplifier 32, the capacitor 33, and the switch 34 form a current/voltage converting unit 39. Note that the current/voltage converting unit 39 and the DA converter 31 also function as components or a data line driving unit 310.

A digital video signal is supplied to an input terminal of the DA converter 31. The DA converter 31 converts the digital video signal VDa into an analog voltage. The analog voltage is a video signal voltage or a monitoring voltage. An output terminal of the DA converter 31 is connected to a non-inverting input terminal of the operational amplifier 32. Thus, the video signal voltage or the monitoring voltage is supplied to the non-inverting input terminal of the operational amplifier 32. An inverting input terminal of the operational amplifier 32 is connected to the data line S(j). The switch 34 is provided between the inverting input terminal and output terminal of the operational amplifier 32. The capacitor 33 is provided in parallel to the switch 34 and between the inverting input terminal and output terminal of the operational amplifier 32. An input and output control signal DWT included in the source control signals SCTL, is supplied to a control terminal of the switch 34. The output terminal of the operational amplifier 32 is connected to an input terminal of the AD converter 35.

In a configuration such as that described above, when the input and output control signal DWT is at a high level, the switch 34 is in an on state, and a state between the inverting input terminal and output terminal of the operational amplifier 32 is in a short-circuited state. At this time, the operational amplifier 32 functions as a buffer amplifier. By this, a voltage (a video signal voltage or a monitoring voltage) supplied to the non-inverting input terminal of the operational amplifier 32 is applied to the data lines S(j). When the input and output control signal DWT is at a low level, the switch 34 is in an off state, and the inverting input terminal and output terminal of the operational amplifier 32 are connected to each other through the capacitor 33. At this time, the operational amplifier 32 and the capacitor 33 function as an integrator circuit. By this, an output voltage from the operational amplifier 32 is a voltage depending on a current flowing through the data line S(j.) The AD converter 35 converts the output voltage from the operational amplifier 32 into a digital value. Data obtained after the conversion is sent as the monitoring data MO to the display control circuit 10.

Note that although a signal line for supplying a data voltage (a video signal voltage or a monitoring voltage) and a signal line for measuring a current are shared in the present embodiment, it is not limited thereto. A configuration can also be adopted in which a signal line for supplying a data voltage and a signal line for measuring a current are provided independently of each other. In addition, as for the configuration of the pixel circuit 410, too, other configurations than the configuration shown in FIG. 4 can also be adopted. That is, there are no particular limitations on specific circuit configurations of the current monitoring unit 320 and the pixel circuit 410.

<1.3 Processes During a Characteristics Detection Period>

Next, processes performed during the characteristics detection period will be described. During the characteristics detection period, the characteristics detection monitoring is performed. Note that in the following, characteristics of the drive transistor T2 is referred to as "TFT characteristics", and characteristics or the organic EL element 411 is referred to as "OLED characteristics". Note also that a row that is a target for the characteristics detection monitoring is referred to as "monitoring row".

Figure 5:
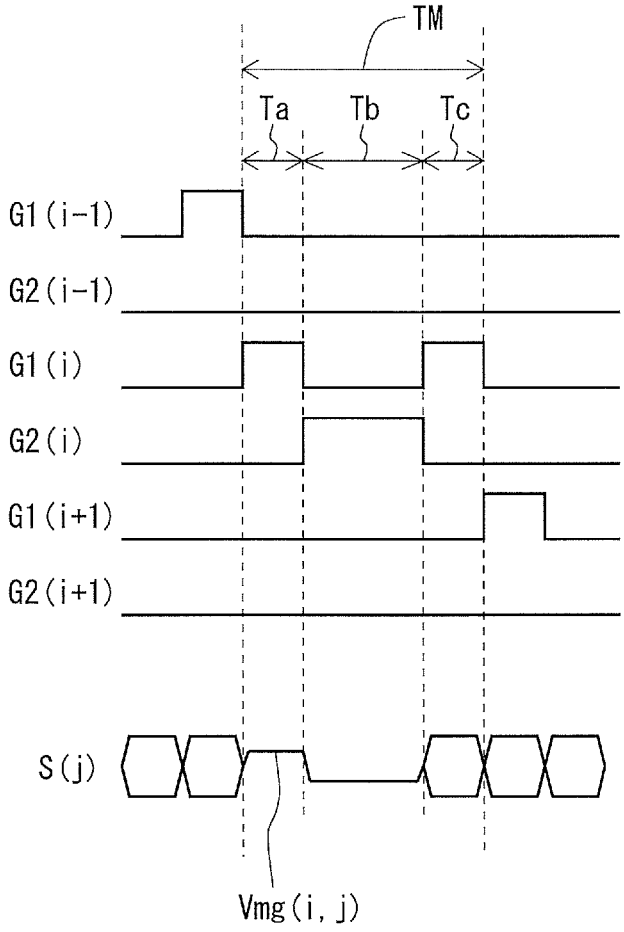
FIG. 5 is a timing diagram for describing a driving method for performing the characteristics detection monitoring in the first embodiment.

FIG. 5 is a timing chart for describing a driving method for performing the characteristic detection monitoring. Note that FIG. 5 shows an example in which the characteristics detection monitoring is performed for an ith row. In FIG. 5, a period indicated by reference character TM is the characteristics detection period. The characteristics detection period TM includes a period during which preparation for detecting TFT characteristics or OLED characteristics is performed in the monitoring row (hereinafter, referred to as "detection preparation period") Ta; a period during which current measurement for detecting characteristics is performed (hereinafter, referred to as "current measurement period") Tb; and a period during which writing of video signal voltages (data voltages corresponding to a normal display image) is performed in the monitoring row (hereinafter, referred to as "video signal voltage writing period") Tc.

During the detection preparation period Ta, the scanning line G1(*i*) is brought into an active state, and the monitoring control line G2(*i*) is maintained in a non-active state. By this, the input transistor goes into an on state, and the monitoring control transistor T3 is maintained in an off State. In addition, during the detection preparation period Ta, a monitoring voltage Vmg(i, j) is applied to the data line S(j). Note that the monitoring voltage Vmg(i, j) does not indicate a fixed voltage, and the magnitude of the monitoring voltage Vmg(i, j) differs between when TFT characteristics are detected and when OLED characteristics are detected. That is, the monitoring voltage used here is a concept including both a monitoring voltage for detecting TFT characteristics (hereinafter, referred to as "TFT characteristics measurement voltage") and a monitoring voltage for detecting OLED characteristics (hereinafter, referred to as "OLED characteristics measurement voltage"). When the monitoring voltage Vmg(i, j) is the TFT characteristics measurement voltage, the drive transistor T2 is in an on state. When the monitoring voltage Vmg(i, j) is the OLED characteristics measurement voltage, the drive transistor T2 is maintained in an off state.

Meanwhile, the TFT characteristics measurement voltage applied to the data line S(j) during the detection preparation period Ta is set so as to satisfy "TFT characteristics measurement voltage<the threshold voltage of the organic EL element 411+the threshold voltage of the drive transistor or T2". This setting enables measurement of only characteristics of the drive transistor T2 with no current flowing through the organic EL element 411 during the current measurement period Tb. In addition, the OLED characteristics measurement voltage applied to the data line S(j) during the detection preparation period Ta is set so as to satisfy "OLED characteristics measurement voltage<the threshold voltage of the organic EL element 411 +the threshold voltage of the drive transistor T2". This setting enables measurement of only characteristics of the organic EL element 411 without the drive transistor T2 going into an on state during the current measurement period Tb.

Figure 6:
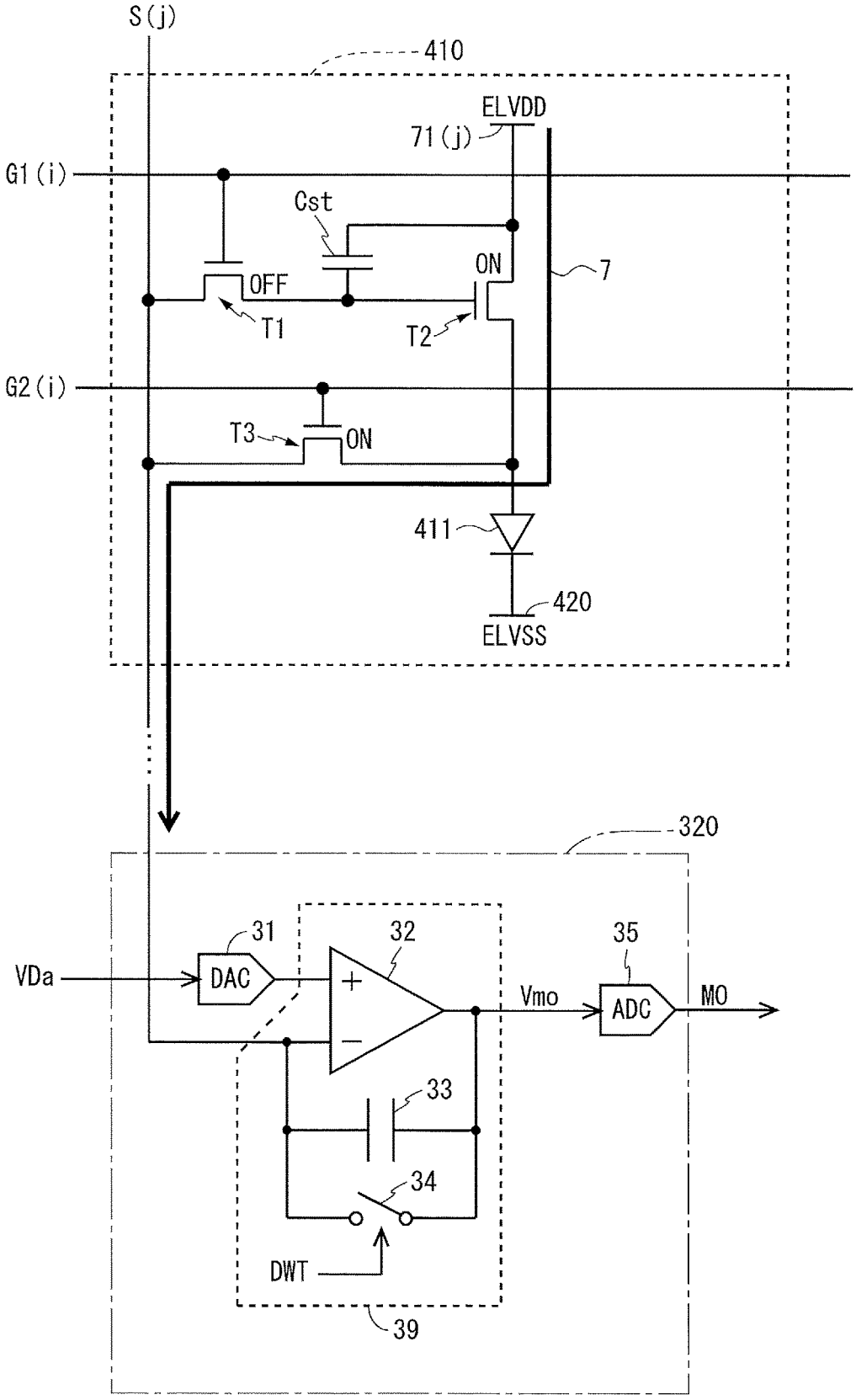
FIG. 6 is a diagram for describing a current flow during a current measurement period for case of detecting characteristics of a drive transistor in the first embodiment.
Figure 7:
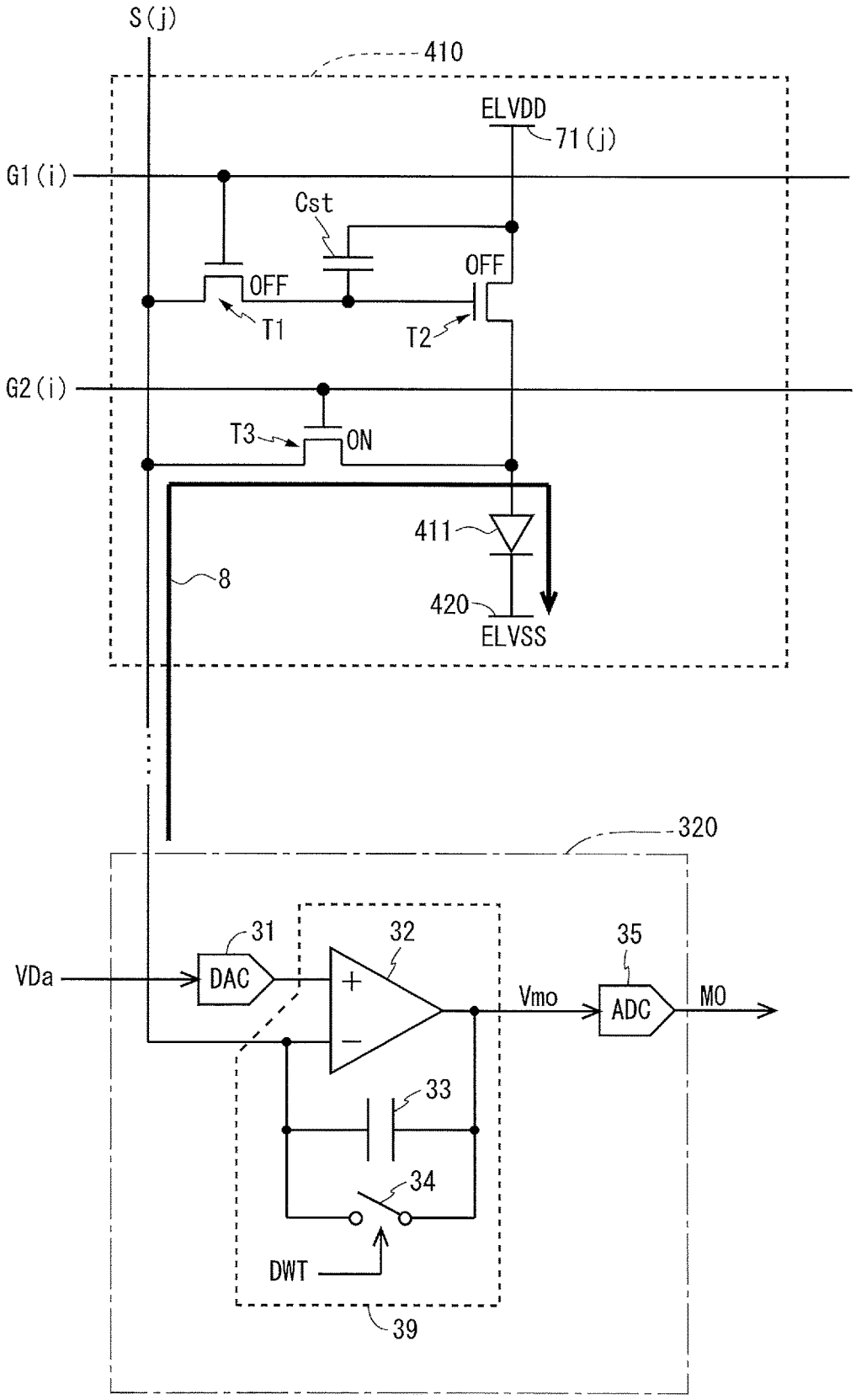
FIG. 7 is a diagram for describing a current flow during a current measurement period for a case of detecting characteristics of an organic EL element in the first embodiment.

During the current measurement period Tb, the scanning line G1(*i*) is brought into a non-active state and the monitoring control line G2(*i*) is brought into an active state. By this, the input transistor T1 goes into an off state and the monitoring control transistor T3 goes into an on state. Here, when the monitoring voltage Vmg(i, j) is the TFT characteristics measurement voltage, as described above, the drive transistor T2 goes into an on state and a current does not flow through the organic EL element 411. Thus, as indicated by an arrow indicated by reference character 7 in FIG. 6, a current flowing through the drive transistor T2 is outputted to the data line S(j) through the monitoring control transistor T3. In this state, the current flowing through the data line S(j) is measured by the current monitoring unit 320 in the source driver 30. On the other hand, when the monitoring voltage Vmg(i, j) is the OLED characteristics measurement voltage, the drive transistor T2 is maintained in an off state as described above and a current flows through the organic EL element 411. The is, a current flows through the organic EL element 411 from the data line S(j) through the monitoring control transistor T3 as indicated by an arrow indicated by reference character 8 in FIG. 7, and the organic EL element 411 emits light. In this state, the current flowing through the data line S(j) is measured by the current monitoring unit 320 in the source driver 30.

Figure 8:
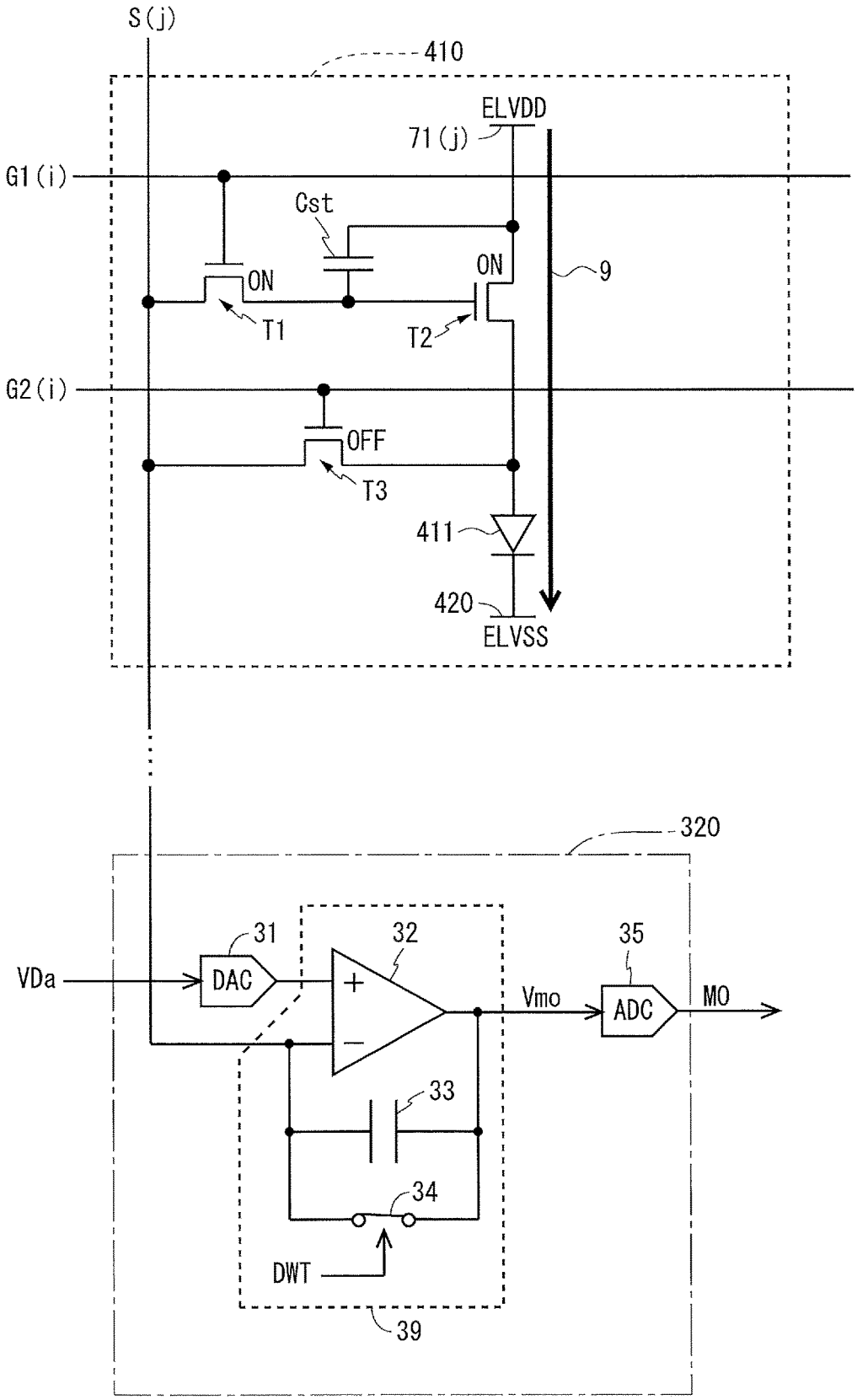
FIG. 8 is a diagram for describing a current flow during a video signal voltage writing period in the first embodiment.

During the video signal voltage writing period Tc, the scanning line G1(*i*) is brought into an active state and the monitoring control line G2(*i*) is brought into a non-active state. By this, the input transistor T1 goes into an on state and the monitoring control transistor T3 goes into an of state. In addition, during the video signal voltage writing period Tc, a data voltage depending on target luminance is applied to the data line S(j). By this, the drive transistor T2 goes into an on state. As a result, as indicated by an arrow indicated by reference character 9 in FIG. 8, a drive current is supplied to the organic EL element 411 through the drive transistor T2. By this, the organic EL element 411 emits light at luminance depending on the drive current.

<1.4 Processes During a Determination Period>

Next, processes performed during the determination period will be described. During the determination period, the average degradation level detection monitoring including a total current measurement process by the total current measuring circuit 50 is performed, and a determination as to whether to perform the above-described characteristics detection monitoring is made based on a result of the monitoring.

Figure 9:
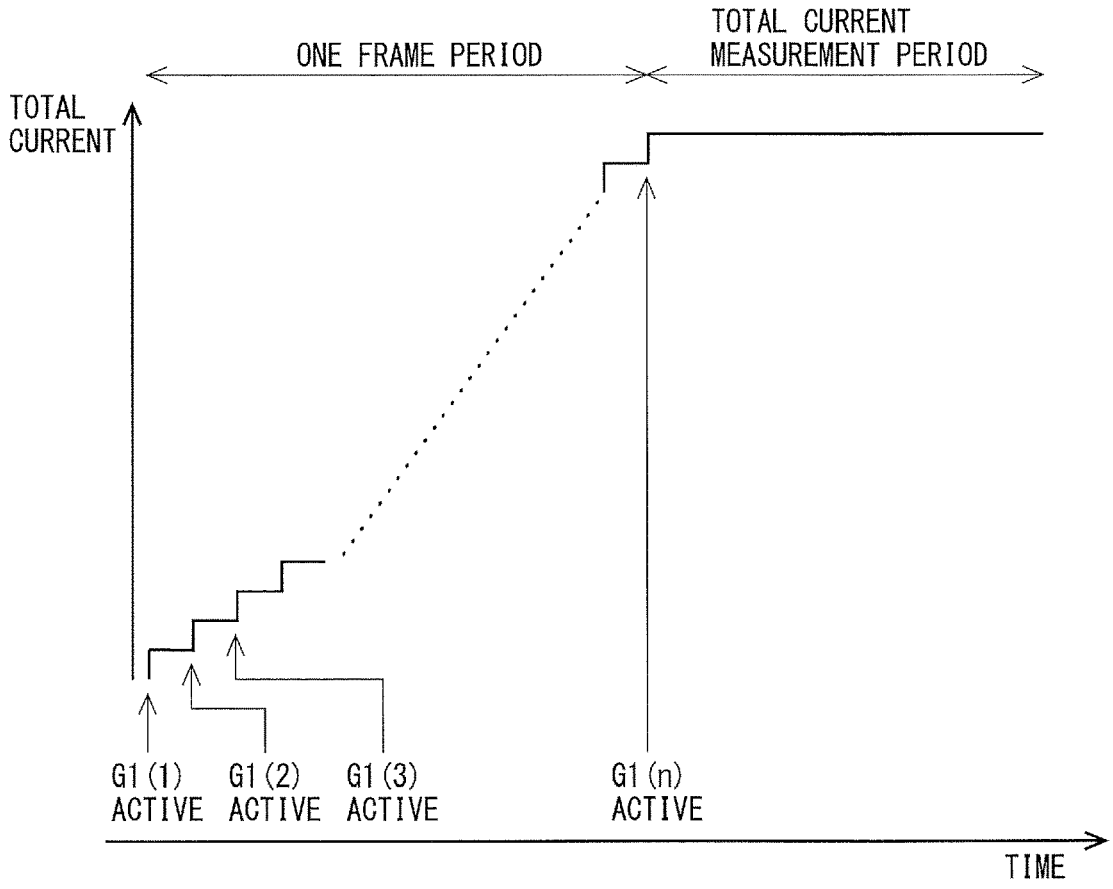
FIG. 9 is a diagram for describing measurement of a total current in the first embodiment.

During the determination period, in order for the total current measuring circuit 50 to measure the total current, first, in a state where a data voltage (monitoring voltage) corresponding to the total current measurement image is applied to the data lines S(1) to S(m), the scanning lines G1 are sequentially brought into an active state one by one as shown in FIG. 9. Then, after the scanning line G1(*n*) is brought into an active state, total current measurement by the total current measuring circuit 50 starts. Note that the monitoring control lines G2(1) to G2(*n*) are maintained in a non-active state throughout the determination period.

During a total current measurement period shown in FIG. 9, a drive current depending on a monitoring voltage flows through all pixel circuits 410 (however, depending variations in the threshold voltage of the drive transistors T2, variations also occur in drive current). At this time, the above-described total current flows through the high power supply voltage trunk wiring line 70. The total current is measured by the total current measuring circuit 50.

Note that in the present embodiment, two images are prepared as total current measurement images. That is, the total current is measured based on monitoring voltages at two levels. Thus, total current data DI obtained during a single determination period includes data of two total currents (a first total current and a second total current). Note that a first data voltage and a second data voltage are implemented by the above-described monitoring voltages at two levels.

After completion of the total current measurement, the determining unit 120 determines whether to perform the characteristics detection monitoring. Upon the determination, an average threshold voltage of the drive transistors T2 in the display unit 40 is determined based on the first total current and the second total current. Note that the value of the average threshold voltage used here is not a precise value (an actual average value of the threshold voltages of the drive transistors T2 in the display unit 40) but is an estimated value. Now, how to determine the average threshold voltage of the drive transistors T2 will be described with reference to FIG. 10. A relationship between the square root of a gate-to-source voltage Vgs of the drive transistor T2 and a drain-to-source current Ids of the drive transistor T2 is a linear relationship. Thus, a relationship between the square root of a gate-to-source voltage Vgs corresponding to a monitoring voltage for total current measurement and a drain-to-source current Ids corresponding to the total current is also a linear relationship. Hence, as can be grasped from FIG. 10, the average threshold voltage of the drive transistors T2 in the display unit 40 can be determined based on a straight line obtained from two total currents (the first total current and the second total current) corresponding to two monitoring voltages V1 and V2. That is, an average degradation level of the drive transistors T2 can be determined.

Figure 10:
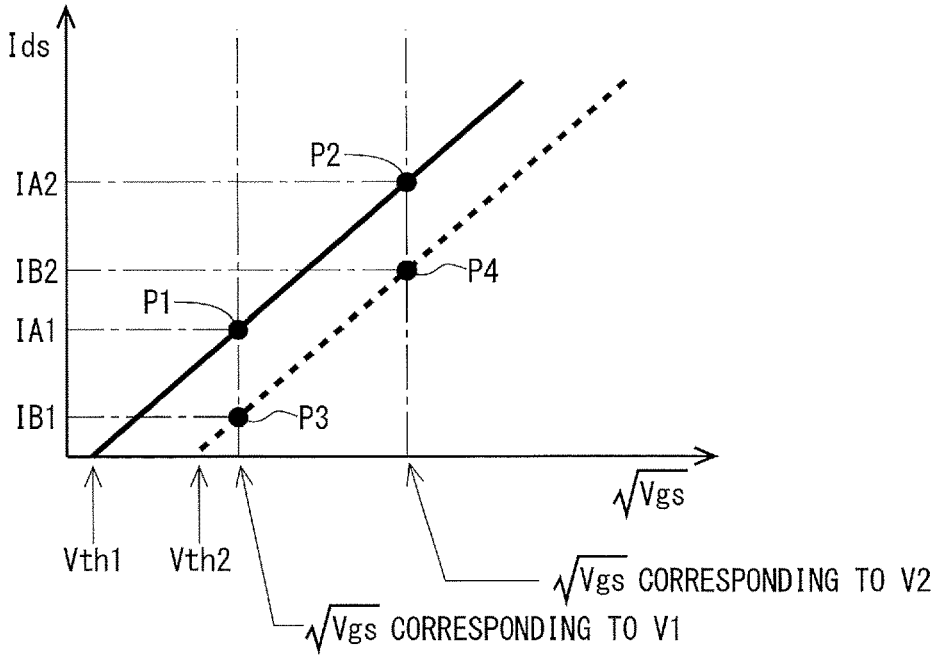
FIG. 10 is a diagram for describing how to determine an average threshold voltage of drive transistors in the first embodiment.

Regarding FIG. 10, when drain-to-source currents Ids corresponding to the first total current and the second total current at a given point in time (referred to as "first point in time") are IA1 and IA2, respectively, an average threshold voltage Vth1 of the drive transistors T2 at the first point in time is determined based on a straight line connecting a point P1 to a point P2. In addition, when drain-to-source currents Ids corresponding to the first total current and the second total current at another point in time after the first point in time (referred to as "second point in time") are IB1 and IB2, respectively, an average threshold voltage Vth2 of the drive transistors at the second point in time is determined based on a straight line connecting a point P3 to a point P4. As such, normally, the average threshold voltage Vth2 at the second point in time is greater than the average threshold voltage Vth1 at the first point in time.

Hence, finally, a difference between the average threshold voltage of the drive transistors T2 obtained when the characteristics detection monitoring is performed last time and the average threshold voltage of the drive transistors T2 obtained at the most recent measurement is determined. Then, when the difference is greater than a predetermined value (e.g., 0.2 V) (this value is held in the determination data storage unit 110), it i determined to perform the characteristics detection monitoring.

As described above, in the present embodiment, the total current measuring circuit 50 measures the first total current which is the total current obtained in a state where the first data voltage is written into all pixel circuits 410, and the second total current which is the total current obtained in a state where the second data voltage is written into all pixel circuits 410. Then, after completion of the total current measurement by the total current measuring circuit 50, the determining unit 120 determines the average threshold voltage of the drive transistors T2 included in all pixel circuits 410 based on the first total current and the second total current, and determines to perform the characteristics detection monitoring when a difference between the average threshold voltage (i.e., an average threshold voltage determined most recently) and the average threshold voltage determined when the characteristics detection monitoring is performed last time is greater than a voltage value as determination data.

<1.5 Effects>

According to the present embodiment, the organic EL display device is provided with the total current measuring circuit 50 that measures the total current flowing through the entire screen (the entire display unit 40) when a specific image (the total current measurement image) is displayed. By such a configuration, an average degradation level of the drive transistors T2 on the entire screen can be promptly determined. Then, the determining unit 120 determines whether to perform the characteristics detection monitoring, based on the average degradation level of the drive transistors T2 on the entire screen. As a result, if degradation has progressed, then the characteristics detection monitoring is performed, but if degradation has not progressed, then the characteristics detection monitoring is not performed. Thus, the characteristics detection monitoring is not performed more often than necessary, and degradation of the drive transistors T2 is efficiently compensated for. As described above, according to the present embodiment, an organic EL display device is implemented that can more efficiently compensate for degradation of drive transistors T2 by promptly determining an average degradation level of the drive transistors T2 on the entire screen.

<1.6 Variant>

In the above-described first embodiment, the total current measuring circuit 50 measures, as the total current, currents flowing through the high power supply voltage trunk wiring line 70 when a specific image (the total current measurement image) is displayed. However, the configuration is not limited thereto. The total current measuring circuit 50 may measure, as the total current, currents flow through the low power supply voltage trunk wiring line 75 when a specific image (the total current measurement image) is displayed. In this case, the total current measuring circuit 50 is provided between the low voltage drive power supply 62 and the common electrode 420.

2. Second Embodiment

A second embodiment will be described. Note that the following mainly describes only differences from the first embodiment.

<2.1 Configuration>

Figure 11:
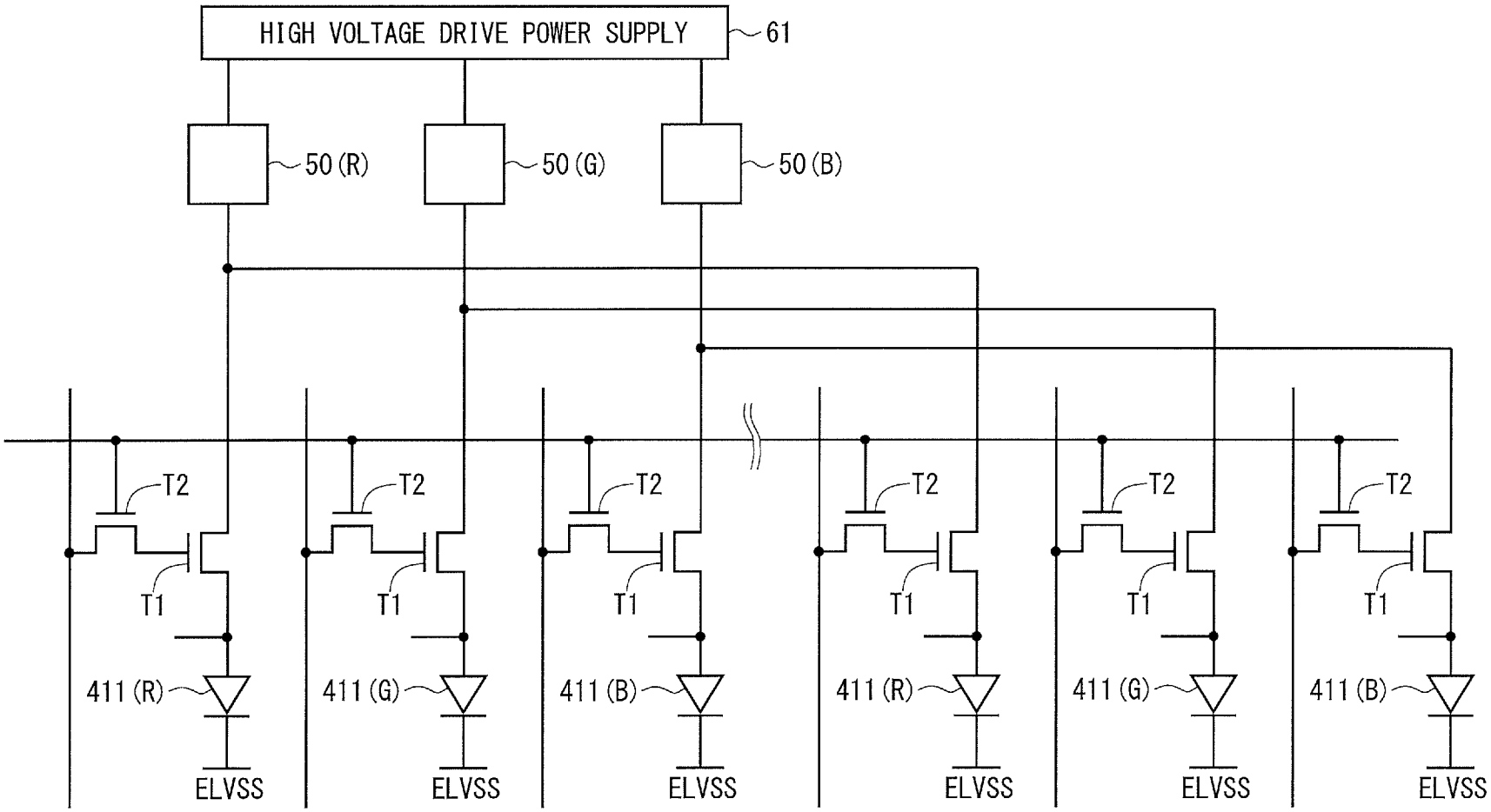
FIG. 11 is a diagram for describing total current measuring circuits in a second embodiment.

FIG. 11 is a diagram for describing total current measuring circuits in the present embodiment. In the first embodiment, the organic EL display device is provided with one total current measuring circuit 50. On the other hand, in the present embodiment, one total current measuring circuit 50 is provided for each color of the organic EL elements 411. When one pixel is composed of a red subpixel, a green subpixel, and a blue subpixel, as shown in FIG. 11, an organic EL display device is provided with one red total current measuring circuit 50(R) one green total current measuring circuit 50(G), and one blue total current measuring circuit 50(B). Each total current measuring circuit measures, as the total current, drive currents flowing through all pixel circuits 410 for a corresponding color. Note that, since wiring lines are independent of each other for each color as can be grasped from FIG. 11, total currents for all colors can be measured at the same timing.

Note that although here an example in which one pixel is formed of subpixels of three colors is described, the configuration according to the present embodiment can also be adopted for a case in which one pixel is formed of subpixels of four or more colors. That is, the configuration according to the present embodiment can be adopted, in a case in which N is an integer greater than or equal to 3, when one pixel is formed of subpixels of N colors (in other words, when one pixel is formed of N pixel circuits 410 (=responding to the N colors)

<2.2 Effects>

In general, an organic EL element has different degradation characteristics for different colors. In this regard, according to the present embodiment, since the total current can be measured for each color, a monitoring voltage used upon the characteristics detection monitoring can be set for each color, taking into account a degradation characteristics for each color. By this, the degree of degradation of the drive transistors T2 or the organic EL elements 411 can be more accurately grasped, and degradation is more accurately compensated for.

3. Third Embodiment

<3.1 Summary>

In the first embodiment, the determination data storage unit 110 in the display control circuit 10 (see FIG. 1) holds a predetermined voltage value as determination data. On the other hand, in toe present embodiment, the determination data storage unit 110 holds, as determination data, information on a correspondence between a total current and a degradation level (the degradation level of the drive transistors T2). The determination data is obtained based on IV characteristics (IV characteristics of the drive transistors T2) which is estimated from a result of the average degradation level detection monitoring (i.e., the value of the total current).

In addition, in the first embodiment, two monitoring voltages are used for one average degradation level detection monitoring. Then, based on straight lines obtained from the values of two total currents (the first total current and the second total current) which are monitoring results, the average threshold voltage of the drive transistors T2 is determined. On the other hand, in the present embodiment only one monitoring voltage is used for one average degradation level detection monitoring.

Figure 12:
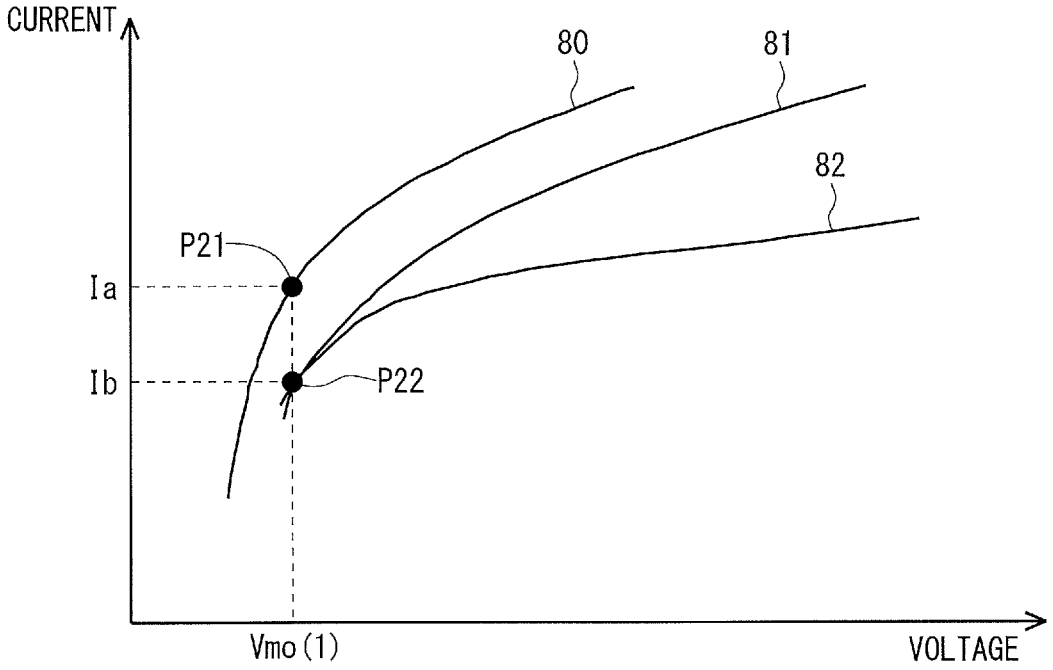
FIG. 12 is a diagram for describing the fact that IV characteristics are not estimated with sufficient accuracy when only one monitoring voltage is used, regarding a third embodiment.

Meanwhile, in a case in which IV characteristics of the drive transistors T2 are estimated using only one monitoring voltage, sufficient estimation accuracy cannot be obtained (estimation error increase). This will be described with reference to FIG. 12. It is assumed that IV characteristics of the drive transistors T2 at a given point in time (referred to as "point in time A" for convenience sake) are represented by a curve given reference character 80 in FIG. 12. When the total current is measured in a state where the monitoring voltage is set to Vmo(1) at the point in time A, the value of the total current is Ia as shown in FIG. 12 (see a coordinate point P21). When the total current is measured in a state where the monitoring voltage is set to Vmo(1) again at a point in time where a predetermined period has elapsed from the point in time A (referred to as "point in time B" for convenience sake), the value of the total current is smaller than Ia. This is because with the passage of time, the threshold voltage of the drive transistors 12 increases due to degradation, increasing the resistance of the pixel circuits 410. At the point in time B, the value of the total current is, for example, Ib as shown in FIG. 12 (see a coordinate point P22). At this time, the coordinate point P22 is located on a portion that corresponds to a very small gradation level on the curve representing IV characteristics of the drive transistors T2 at the point in time B. Hence, for example, it is estimated that "the IV characteristics are represented by a curve given reference character 82 in FIG. 12" when the actual IV characteristics are represented by a curve given reference character 81 in FIG. 12. As such, a difference between the actual IV characteristics and the estimated IV characteristics may remarkably increase.

Hence, in the present embodiment, when the value of the total current detected by the average degradation level detection monitoring is smaller than that obtained at a base time by a predetermined threshold or more, the value of the monitoring voltage is set to a value higher than the value having been set so far, and the above-described determination data is updated. Differences in the configuration of the present embodiment from the first embodiment will be specifically described below.

<3.2 Configuration>

As described above, in the present embodiment, the determination data storage unit 110 in the display control circuit 10 holds, as determination data, information on the correspondence between the total current and the degradation level (the degradation level of the drive transistors T2). The correspondence between the total current and the degradation level is schematically represented by a straight line given reference character 83 in FIG. 13. Note that the correspondence between the total current and the degradation level depends on the value of the monitoring voltage. Thus, the determination data (information on the correspondence) is updated in response to a change in the value of the monitoring voltage.

Figure 13:
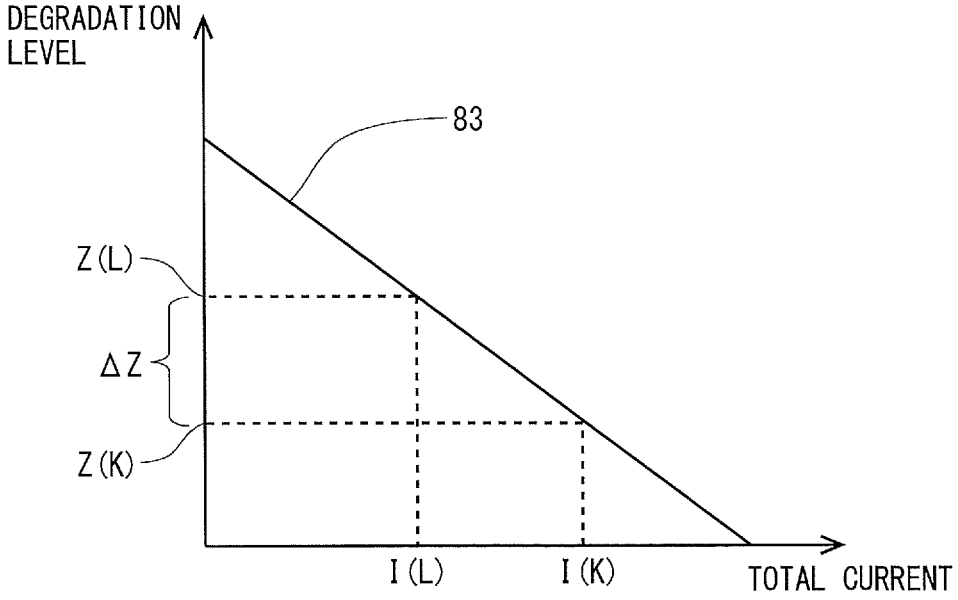
FIG. 13 is a diagram schematically showing a correspondence between a total current and a degradation level (a degradation level of drive transistors) in the third embodiment.

The determining unit 120 in the display control circuit 10 determines a degradation progress level ΔZ by referring to information on the correspondence between the total current and the degradation level, based on the value I(K) of the total current obtained by the average degradation level detection monitoring performed when the determination data is updated last time (at a base time) and the value I(L) of the total current obtained by the most recent average degradation level detection monitoring (see FIG. 13). Note that the degradation progress level ΔZ corresponds to a difference between a degradation level Z(L) corresponding to the value I(L) of the total current and a degradation level Z(K) corresponding to the value I(K) of the total current. Every time the average degradation level detection monitoring is performed, the determining unit 120 compares the degradation progress level ΔZ with a driven threshold. If, as a result, the degradation progress level ΔZ is greater than the threshold, then the value of the monitoring voltage is set to a value higher than the value having been set so far. In other words, when the value of the total current is smaller than that obtained at a base time by a predetermined threshold or more, the value of the monitoring voltage is set to a value higher than the value having been set so far, the predetermined threshold corresponding to a predetermined amount of increase in degradation level. In addition, when the degradation progress level ΔZ is greater than the threshold, determination data (information on the correspondence between the total current and the degradation level) held in the determination data storage unit 110 is updated based on IV characteristics estimated from the value of the total current obtained by the monitoring voltage that is set to a higher value as described above. In addition, when the degradation progress level ΔZ is greater than the threshold, a screen that prompts a user to perform the characteristics detection monitoring is displayed on the display unit 40. Then, the determining unit 120 determines whether to perform the characteristics detection monitoring, based on a user's operation.

Note that it is preferred that a threshold value to be compared with the degradation progress level ΔZ be a value corresponding to the amount of 1% to 5% drop in the value of the total current. In other words, it is preferred that the value of the monitoring voltage be set to a value higher than the value having been set so far, when the value of the total current has decreased by 1% to 5% compared to that obtained at a base time. In this regard, a reason that a value corresponding to 1% or more of the value of the total current is set as the threshold value is that when a detected degradation progress level ΔZ corresponds to less than 1% of the value of the total current, it is relatively likely that a detection result is within the error range. In addition, a reason that a value corresponding to 5% or less of the value of the total current is set as the threshold value is that if a value corresponding to 5% or more of the value of the total current is set as the threshold value, then the frequency of updates to determination data (information on the correspondence between the total current and the degradation level) decreases, by which the estimation accuracy of IV characteristics decreases, <3.3 Effects>

Figure 14:
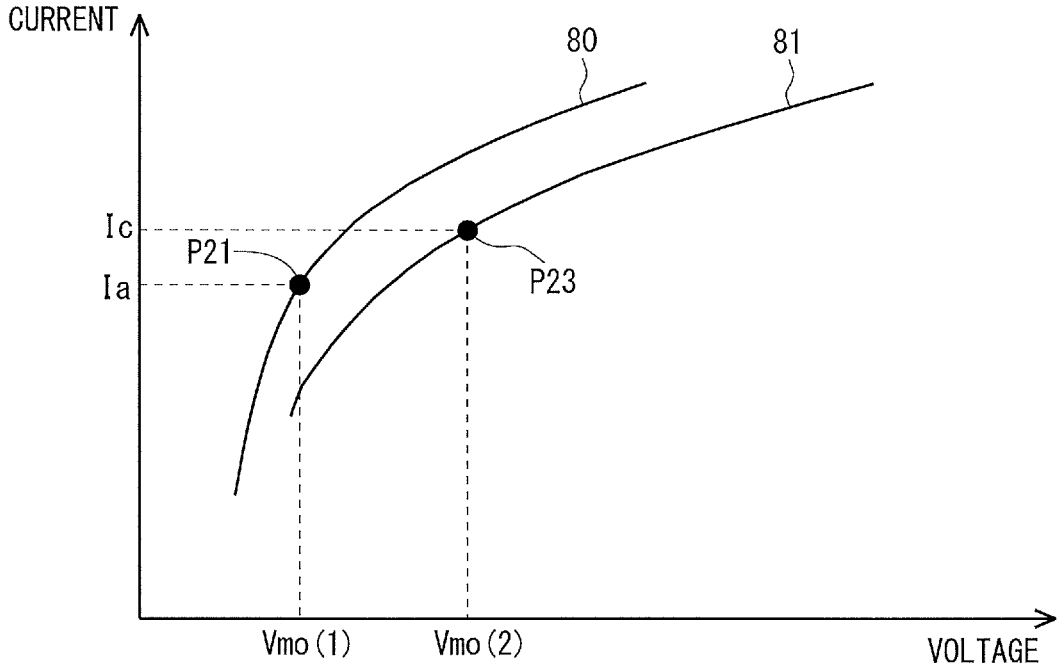
FIG. 14 is a diagram for describing an effect in the third embodiment.

By the above-described configuration, for example, when the degradation progress level ΔZ from the point in time A to the point in time B is greater than the above-described threshold, the value of the monitoring voltage is increased from Vmo(1) to Vmo(2) (see FIG. 14) If the value of the total current measured in a state where the monitoring voltage is set to Vmo(2) is Ic, then a coordinate point P23 shown in FIG. 14 is a point close to the center on a curve representing IV characteristics of the drive transistors T2. Hence, as represented by a curve given reference character 81 in FIG. 14, the IV characteristics of the drive transistors T2 are accurately estimated.

As described above, according to the present embodiment, IV characteristics of the drive transistors T2 are accurately estimated. Then, based on the accurately estimated IV characteristics, determination data used to determine whether to perform the characteristics detection monitoring is updated. Hence, the characteristics detection monitoring is suppressed from being performed unnecessarily. Thus, degradation of the drive transistors T2 is more efficiently compensated for

4. Fourth Embodiment

<4.1 Configuration>

Figure 15:
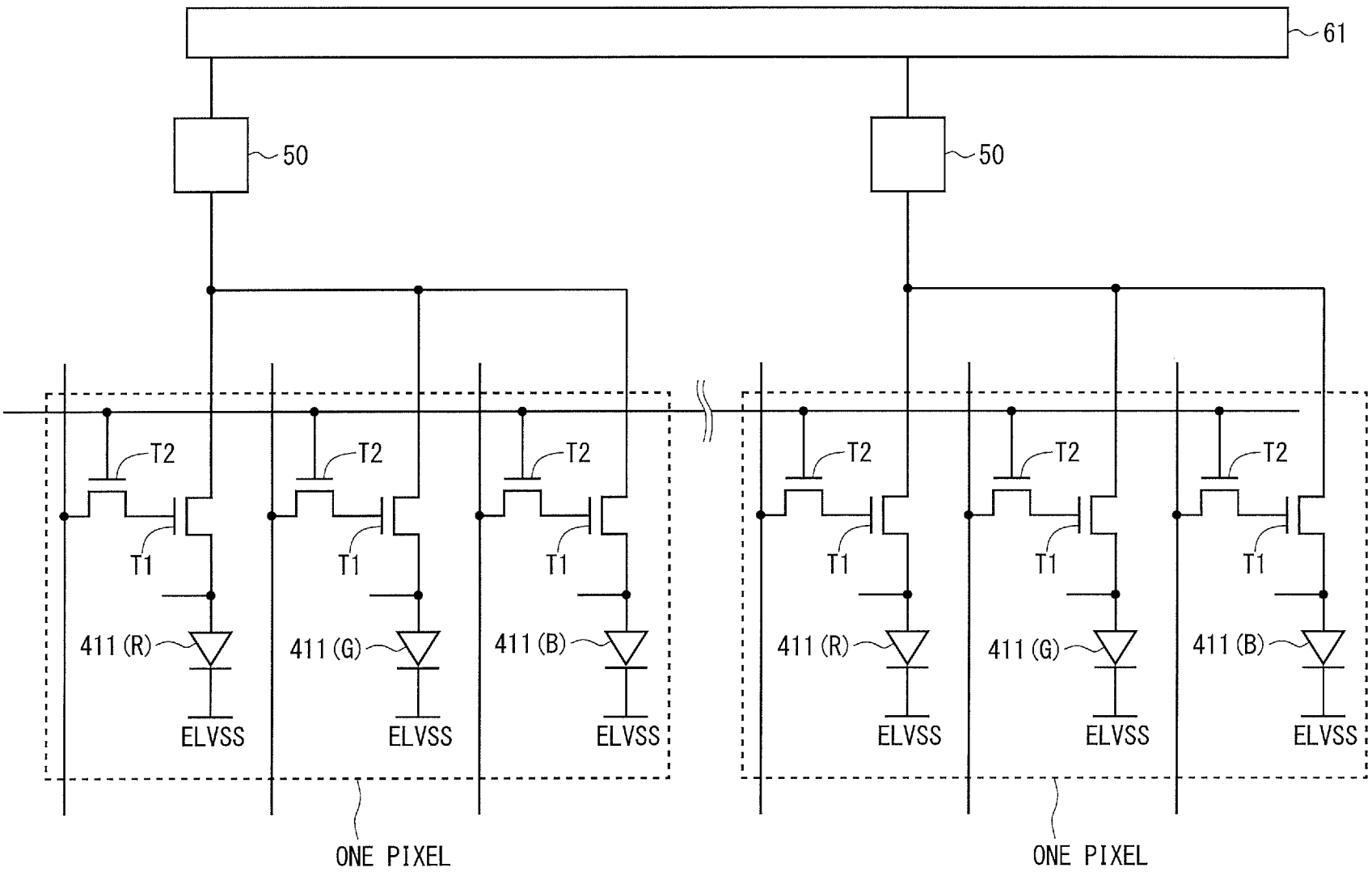
FIG. 15 is a diagram for describing total current measuring circuits in a fourth embodiment.

FIG. 15 is a diagram for describing total current measuring circuits in the present embodiment. In the first embodiment, the organic EL display device is provided with one total current measuring circuit 50. On the other hand, in the present embodiment, one total current measuring circuit 50 is provided for each pixel including a plurality of subpixels (e.g., three subpixels including a red subpixel, a green subpixel, and a blue subpixel). Each total current measuring circuit measures, as the total current, drive currents flowing through three pixel circuits 410 that form a corresponding pixel. Meanwhile, one total current measuring circuit 50 does not need to be provided for each of all pixels, and one total current measuring circuit 50 may be provided for one pixel included in a region of a given size. For example, the entire display unit 40 may be logically divided into 8×6 regions, and one total current measuring circuit 50 may be provided for one pixel included in each region.

Note that although here an example in which one pixel is formed of subpixels of three colors described, the configuration according to the present embodiment can also be adopted for a case in which one pixel is formed of subpixels of four or more colors. That is, the configuration according to the present embodiment can be adopted, in a case in which N is an integer greater than or equal to 3, when one pixel is formed of subpixels of N colors (in other words, when one pixel is formed of N pixel circuits 410 corresponding to the N colors).

<4.2 Effects>

According to the present embodiment, the total current can be measured for each pixel including a plurality of subpixels and thus, a monitoring voltage used upon the characteristics detection monitoring can be set for each pixel, taking into account a pixel location in the entire display unit 40. By this, the degree of degradation of the drive transistors T2 or the organic EL elements 411 can be more accurately grasped, and degradation is more accurately compensated for.

5. Fifth Embodiment

<5.1 Configuration>

Depending on the application of an organic EL display device, a one-fifth region from an upper edge or a lower edge of the display unit 40 may be used as a dedicated region for displaying application software icons. Such a dedicated region tends to have high average luminance over other regions, and continuous display of a still screen tends to be performed in such a dedicated region. Hence, it is conceivable that the degradation level of drive transistors T2 is greater in the dedicated region than in other regions.

Figure 16:
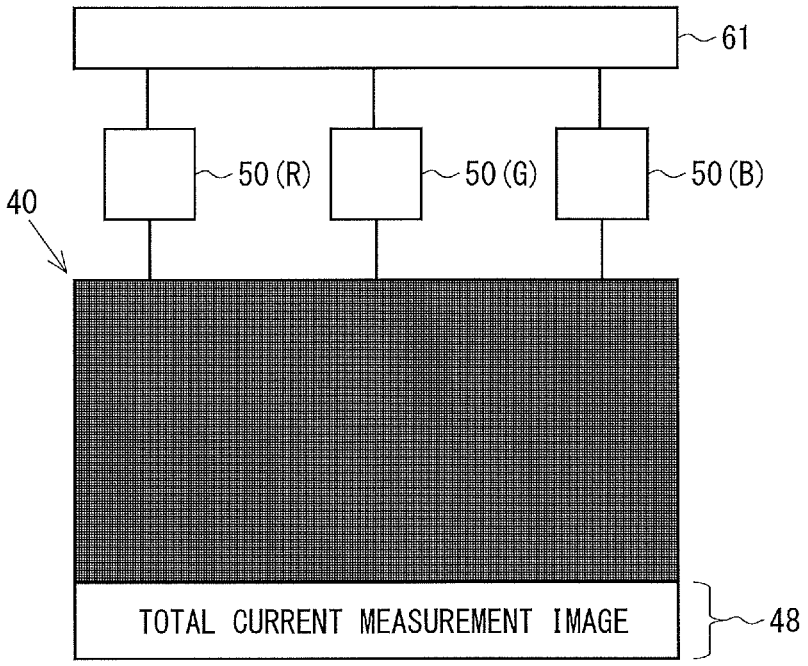
FIG. 16 is a diagram showing an exemplary configuration for a case in which a one-fifth region from a lower edge of a display unit is a dedicated region in a fifth embodiment.
Figure 17:
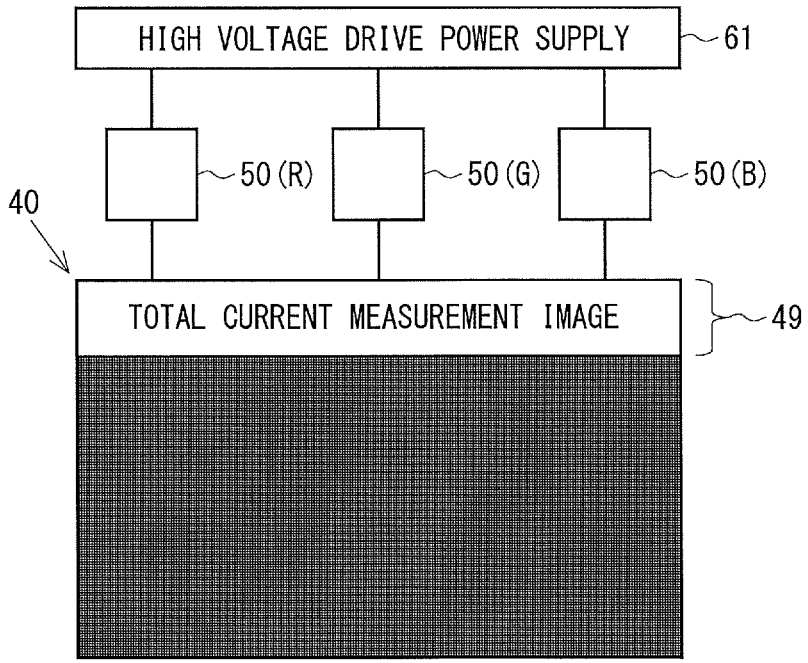
FIG. 17 is a diagram showing an exemplary configuration for a case in which a one-fifth region from an upper edge of the display unit is a dedicated region in the fifth embodiment.

Hence, in an organic EL display device according to the present embodiment, total current measuring circuits 30 measure the total current flowing through the entire screen in a state where the total current measurement image is displayed the dedicated region while a black image is displayed in a region other than the dedicated region (see FIGS. 16 and 17). At this time, since a current does not flow through pixel circuits 410 in the region other than the dedicated region, the total current measured by the total current measuring circuits 50 is the sum of currents flowing through pixel circuits 410 in the dedicated region. As such, in the present embodiment, the total current measuring circuits 50 measure, as the total current, currents flowing through pixel circuits 410 included in a one-fifth region from an edge portion regarding a direction in which the data lines S extend out of the region corresponding to all pixel circuits 410.

Note that FIG. 16 shows an exemplary configuration for a case in which a one-fifth region from a lower edge of the display unit 40 is a dedicated region 48, and FIG. 17 shows an exemplary configuration for case in which a one-fifth region from an upper edge of the display unit 40 is a dedicated region 49. In the examples shown in FIGS. 16 and 17, as in the second embodiment, one total current measuring circuit 50 is provided for each color of the organic EL elements. That is, the organic EL display device is provided with one red total current measuring circuit 50(R), one green total current measuring circuit 50(G), and one blue total current measuring circuit 50(B). However, one total current measuring circuit 50 may be provided as a whole as in the first embodiment, and one total current measuring circuit 50 may be provided for each pixel including a plurality of subpixels as in the fourth embodiment.

<5.2 Effects>

According to the present embodiment, total current measurement by the total current measuring circuits 50 is performed in a state where the total current measurement image is displayed only in a one-fifth region (dedicated region) of the entire display unit 40. Hence, the time required to display the total current measurement image is reduced, enabling more prompt determination of an average degradation level of drive transistors T2, for determining whether to perform characteristics detection monitoring.

<6. Others>

Although each of the above-described embodiments (including the variant) describes an organic EL display device as an example, the configuration is not limited thereto. The disclosure can be applied to any display device as long as the display device includes display elements driven by a current (display elements whose luminance or transmittance is controlled by a current). The disclosure can also be applied to, for example, an inorganic EL display device including inorganic light-emitting diodes or a QLED display device including quantum dot light-emitting diodes (QLEDs).

DESCRIPTION OF REFERENCE CHARACTERS

10: DISPLAY CONTROL CIRCUIT
20: GATE DRIVER
30: SOURCE DRIVER
40: DISPLAY UNIT
50: TOTAL CURRENT MEASURING CIRCUIT
61: HIGH VOLTAGE DRIVE POWER SUPPLY
62: LOW VOLTAGE DRIVE POWER SUPPLY
70: HIGH POWER SUPPLY VOLTAGE TRUNK WIRING LINE
71(1) to 71(*m*): HIGH POWER SUPPLY VOLTAGE BRANCH WIRING LINE
75: LOW POWER SUPPLY VOLTAGE TRUNK WIRING LINE
110: DETERMINATION DATA STORAGE UNIT
120: DETERMINING UNIT
130: MEASURED CURRENT STORAGE UNIT
140: COMPENSATION COMPUTING UNIT
410: PIXEL CIRCUIT
411: ORGANIC EL ELEMENT
T2: DRIVE TRANSISTOR

The invention claimed is:

1. A display device including a plurality of data lines; a plurality of scanning lines; a plurality of pixel circuits provided at respective intersections of the plurality of data lines and the plurality of scanning lines, each pixel circuit including a display element driven by a current and a drive transistor configured to control a drive current of the display element; a data line drive circuit configured to apply data voltages to the plurality of data lines; a scanning line drive circuit configured to drive the plurality of scanning lines; a first power supply voltage member configured to supply a first power supply voltage to the plurality of pixel circuits;

and a second power supply voltage member configured to supply a second power supply voltage to the plurality of pixel circuits, the display device having a function of performing a characteristics detection process that detects characteristics of the drive transistor, wherein in each pixel circuit, the drive transistor and the display element are provided in series between the first power supply voltage member and the second power supply voltage member, the display device includes:

a total current measuring circuit configured to measure, as a total current, drive currents flowing through all of the plurality of pixel circuits or two or more pixel circuits among the plurality of pixel circuits in a state where a data voltage is written into the plurality of pixel circuits, the data voltage corresponding to a specific image;

a determination data storage circuit configured to hold determination data used to determine whether to perform the characteristics detection process; and a determining circuit configured to determine whether to perform the characteristics detection process, based on the total current and the determination data, when the determining circuit determines, during a determination period, to perform the characteristics detection process, a transition is made from the determination period to a characteristics detection period during which the characteristics detection process is performed, when the determining circuit determines, during the determination period, not to perform the characteristics detection process, a transition is made from the determination period to a display period during which normal image display is performed, a first data voltage and a second data voltage are prepared as the data voltage corresponding to the specific image, the second data voltage being a voltage different from the first data voltage, the determination data is a voltage value, the total current measuring circuit measures a first total current and a second total current, the first total current being a total current obtained in a state where the first data voltage is written into the plurality of pixel circuits, and the second total current being a total current obtained in a state where the second data voltage is written into the plurality of pixel circuits, and the determining circuit:

determines an average threshold voltage of drive transistors included in the plurality of pixel circuits, based on the first total current and the second total current; and determines to perform the characteristics detection process when a difference between an average threshold voltage determined when the characteristics detection process is performed last time and an average threshold voltage determined most recently is greater than a voltage value as the determination data.

2. The display device according to claim 1, comprising:

a current measuring circuit configured to measure a current supplied from each pixel circuit during the characteristics detection period;

a measured current storage circuit configured to hold current values, the current values being results of the current measurement by the current measuring circuit; and a compensation computing circuit configured to generate video signals corresponding to data voltages to be supplied to the respective pixel circuits, by correcting input video signals depending on the current values held in the measured current storage circuit, wherein the data line drive circuit applies, during the characteristics detection period, a predetermined data voltage for detecting characteristics of the drive transistor to the plurality of data lines, and applies, during the display period, data voltages corresponding to the video signals generated by the compensation computing circuit to the plurality of data lines.

3. The display device according to claim 1, wherein the first power supply voltage member is a plurality of first power supply voltage branch wiring lines provided so as to have a one-to-one correspondence with the plurality of data lines, the display device includes a first power supply voltage trunk wiring line connected to the plurality of first power supply voltage branch wiring lines and a supply source of the first power supply voltage, and the total current measuring circuit measures, as the total current, currents flowing through the first power supply voltage trunk wiring line.

4. The display device according to claim 1, wherein the second power supply voltage member is a common electrode that is a planar electrode provided in a region corresponding to all of the plurality of pixel circuits, the display device includes a second power supply voltage trunk wiring line connected to the common electrode and a supply source of the second power supply voltage, and the total current measuring circuit measures, as the total current, currents flowing through the second power supply voltage trunk wiring line.

5. The display device according to claim 1, wherein the total current measuring circuit measures, as the total current, drive currents that flow through all of the plurality of pixel circuits, at a time.

6. The display device according to claim 1, wherein one pixel is formed of N pixel circuits corresponding to N colors (N is an integer greater than or equal to 3), the display device includes N total current measuring circuits for the respective N colors, and each total current measuring circuit measures, as the total current, currents flowing through pixel circuits for a corresponding color among the plurality of pixel circuits.

7. The display device according to claim 1, wherein the total current measuring circuit measures, as the first total current or the second total current, drive currents that flow through all of the plurality of pixel circuits, at a time, and the determining circuit determines an average threshold voltage of drive transistors included in all of the plurality of pixel circuits.

8. The display device according to claim 1, wherein one pixel is formed of N pixel circuits corresponding to N colors (N is an integer greater than or equal to 3), the display device includes N total current measuring circuits for the respective N colors, each total current measuring circuit measures, as the total current, currents flowing through pixel circuits for a corresponding color among the plurality of pixel circuits, and the determining circuit determines, for each color, an average threshold voltage of the drive transistor.

9. The display device according to claim 1, wherein one pixel is formed of N pixel circuits corresponding to N colors (N is an integer greater than or equal to 3), the display device includes a plurality of total current measuring circuits for all pixels or some pixels, and each total current measuring circuit measures, as the total current, currents flowing through N pixel circuits forming a corresponding pixel.

10. The display device according to claim 1, wherein the total current measuring circuit measures, as the total current, currents flowing through pixel circuits included in a one-fifth region from an edge portion regarding a direction in which the plurality of data lines extend out of a region corresponding to all of the plurality of pixel circuits.

11. A display device including a plurality of data lines; a plurality of scanning lines; a plurality of pixel circuits provided at respective intersections of the plurality of data lines and the plurality of scanning lines, each pixel circuit including a display element driven by a current and a drive transistor configured to control a drive current of the display element; a data line drive circuit configured to apply data voltages to the plurality of data lines; a scanning line drive circuit configured to drive the plurality of scanning lines; a first power supply voltage member configured to supply a first power supply voltage to the plurality of pixel circuits; and a second power supply voltage member configured to supply a second power supply voltage to the plurality of pixel circuits, the display device having a function of performing a characteristics detection process that detects characteristics of the drive transistor, wherein in each pixel circuit, the drive transistor and the display element are provided in series between the first power supply voltage member and the second power supply voltage member, the display device includes:

a total current measuring circuit configured to measure, as a total current, drive currents flowing through all of the plurality of pixel circuits or two or more pixel circuits among the plurality of pixel circuits in a state where a data voltage is written into the plurality of pixel circuits, the data voltage corresponding to a specific image;

a determination data storage circuit configured to hold determination data used to determine whether to perform the characteristics detection process; and a determining circuit configured to determine whether to perform the characteristics detection process, based on the total current and the determination data, when the determining circuit determines, during a determination period, to perform the characteristics detection process, a transition is made from the determination period to a characteristics detection period during which the characteristics detection process is performed, when the determining circuit determines, during the determination period, not to perform the characteristics detection process, a transition is made from the determination period to a display period during which normal image display is performed, the determination data is data representing a correspondence between a total current and a degradation level of the drive transistor, the data depending on a data voltage written into the plurality of pixel circuits upon measuring a total current by the total current measuring circuit, and when a value of a total current measured by the total current measuring circuit is smaller than a value of a total current obtained at a base time by a predetermined threshold or more, a data voltage written into the plurality of pixel circuits upon measuring a total current by the total current measuring circuit is increased, and the determination data is updated, the predetermined threshold corresponding to a predetermined amount of increase in degradation level.

12. The display device according to claim 11, comprising:

a current measuring circuit configured to measure a current supplied from each pixel circuit during the characteristics detection period;

a measured current storage circuit configured to hold current values, the current values being results of the current measurement by the current measuring circuit; and a compensation computing circuit configured to generate video signals corresponding to data voltages to be supplied to the respective pixel circuits, by correcting input video signals depending on the current values held in the measured current storage circuit, wherein the data line drive circuit applies, during the characteristics detection period, a predetermined data voltage for detecting characteristics of the drive transistor to the plurality of data lines, and applies, during the display period, data voltages corresponding to the video signals generated by the compensation computing circuit to the plurality of data lines.

13. The display device according to claim 11, wherein the first power supply voltage member is a plurality of first power supply voltage branch wiring lines provided so as to have a one-to-one correspondence with the plurality of data lines, the display device includes a first power supply voltage trunk wiring line connected to the plurality of first power supply voltage branch wiring lines and a supply source of the first power supply voltage, and the total current measuring circuit measures, as the total current, currents flowing through the first power supply voltage trunk wiring line.

14. The display device according to claim 11, wherein the second power supply voltage member is a common electrode that is a planar electrode provided in a region corresponding to all of the plurality of pixel circuits, the display device includes a second power supply voltage trunk wiring line connected to the common electrode and a supply source of the second power supply voltage, and the total current measuring circuit measures, as the total current, currents flowing through the second power supply voltage trunk wiring line.

15. The display device according to claim 11, wherein the total current measuring circuit measures, as the total current, drive currents that flow through all of the plurality of pixel circuits, at a time.

16. The display device according to claim 11, wherein one pixel is formed of N pixel circuits corresponding to N colors (N is an integer greater than or equal to 3), the display device includes N total current measuring circuits for the respective N colors, and each total current measuring circuit measures, as the total current, currents flowing through pixel circuits for a corresponding color among the plurality of pixel circuits.

17. The display device according to claim 11, wherein when a value of a total current obtained at most recent measurement is smaller by 1% to 5% than a value of a total current obtained at measurement performed when the determination data is updated last time, a data voltage written into the plurality of pixel circuits upon measuring a total current by the total current measuring circuit is increased.

18. The display device according to claim 11, wherein when the value of a total current measured by the total current measuring circuit is smaller than the value of the total current obtained at the base time by the predetermined threshold or more, a screen that prompts to perform the characteristics detection process is displayed.

19. The display device according to claim 11, wherein one pixel is formed of N pixel circuits corresponding to N colors (N is an integer greater than or equal to 3), the display device includes a plurality of total current measuring circuits for all pixels or some pixels, and each total current measuring circuit measures, as the total current, currents flowing through N pixel circuits forming a corresponding pixel.

20. The display device according to claim 11, wherein the total current measuring circuit measures, as the total current, currents flowing through pixel circuits included in a one-fifth region from an edge portion regarding a direction in which the plurality of data lines extend out of a region corresponding to all of the plurality of pixel circuits.

* * * * *